United States Patent [19]

Jackle et al.

[11] Patent Number: 4,923,070

[45] Date of Patent: May 8, 1990

[54] DISPLAY AND GRAVITY DISPENSING APPARATUS

[75] Inventors: William C. Jackle; Tadeusz Czerkies, both of Chicago, Ill.

[73] Assignee: The Niven Marketing Group, Scottsdale, Ariz.

[21] Appl. No.: 798,516

[22] Filed: Nov. 15, 1985

[51] Int. Cl.[5] ..... A47F 7/00

[52] U.S. Cl. ..... 211/59.2; 211/126; 211/128

[58] Field of Search ..... 211/59.2, 162, 150, 211/134, 128, 181, 187, 126; 312/42

[56] References Cited

U.S. PATENT DOCUMENTS

| | | | |
|---|---|---|---|
| 2,033,861 | 3/1936 | Otte | 211/134 X |
| 2,239,369 | 4/1941 | Nauert | 211/59.2 X |
| 2,891,677 | 6/1959 | Ritchie | 211/59.2 |
| 3,019,907 | 2/1962 | Bellejack | 211/59.2 |
| 3,717,259 | 2/1973 | Fried et al. | 211/181 X |
| 4,194,109 | 3/1980 | Springer | 211/134 X |
| 4,227,758 | 10/1980 | Clare | 211/126 X |
| 4,231,301 | 11/1980 | Barrineau et al. | 211/187 X |
| 4,479,583 | 10/1984 | Franklin et al. | 211/59.2 |
| 4,565,725 | 1/1986 | Spamer et al. | 211/59.2 |

*Primary Examiner*—Blair M. Johnson

*Attorney, Agent, or Firm*—John E. Benoit

[57] ABSTRACT

A display and gravity dispensing apparatus comprising a housing having an opening in the front thereof and a plurality of elongated wire supports mounted in the housing having a downward inclination toward the opening of the housing. Trays for containing the goods to be dispensed are slidably secured on the elongated wire supports by a guide retainer and are maintained in a first angularly inclined position for dispensing the goods. The tray may be moved and supported in an extended position inclined at a greater angle for restocking the tray with the goods without removal of the tray from the housing.

11 Claims, 3 Drawing Sheets

FIG. 4
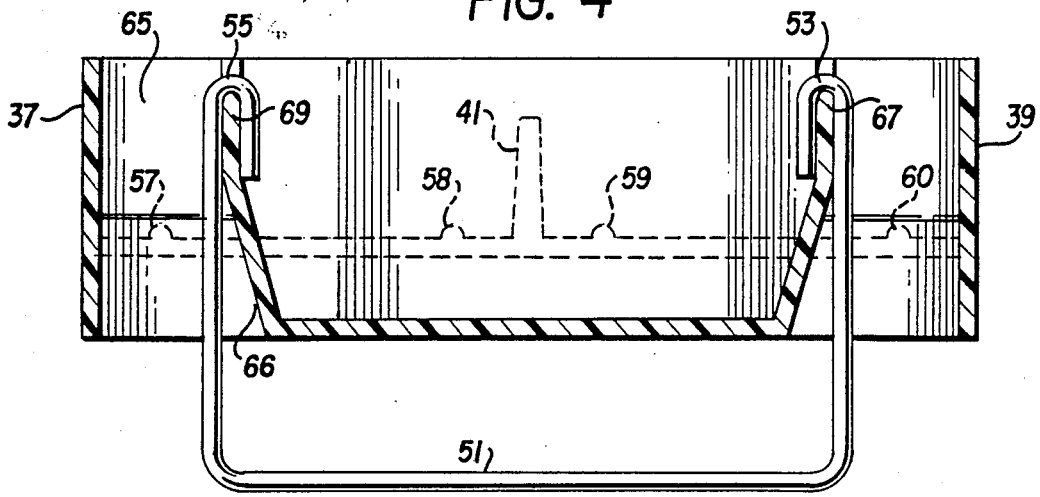
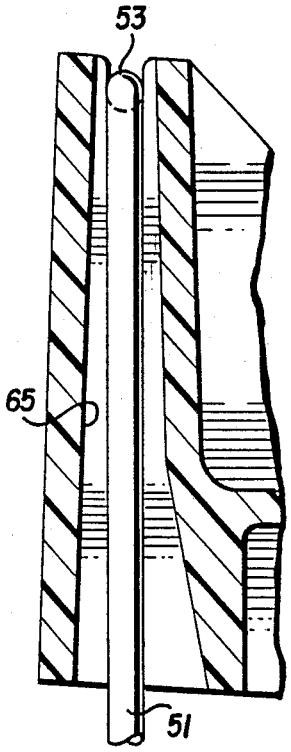
FIG. 5
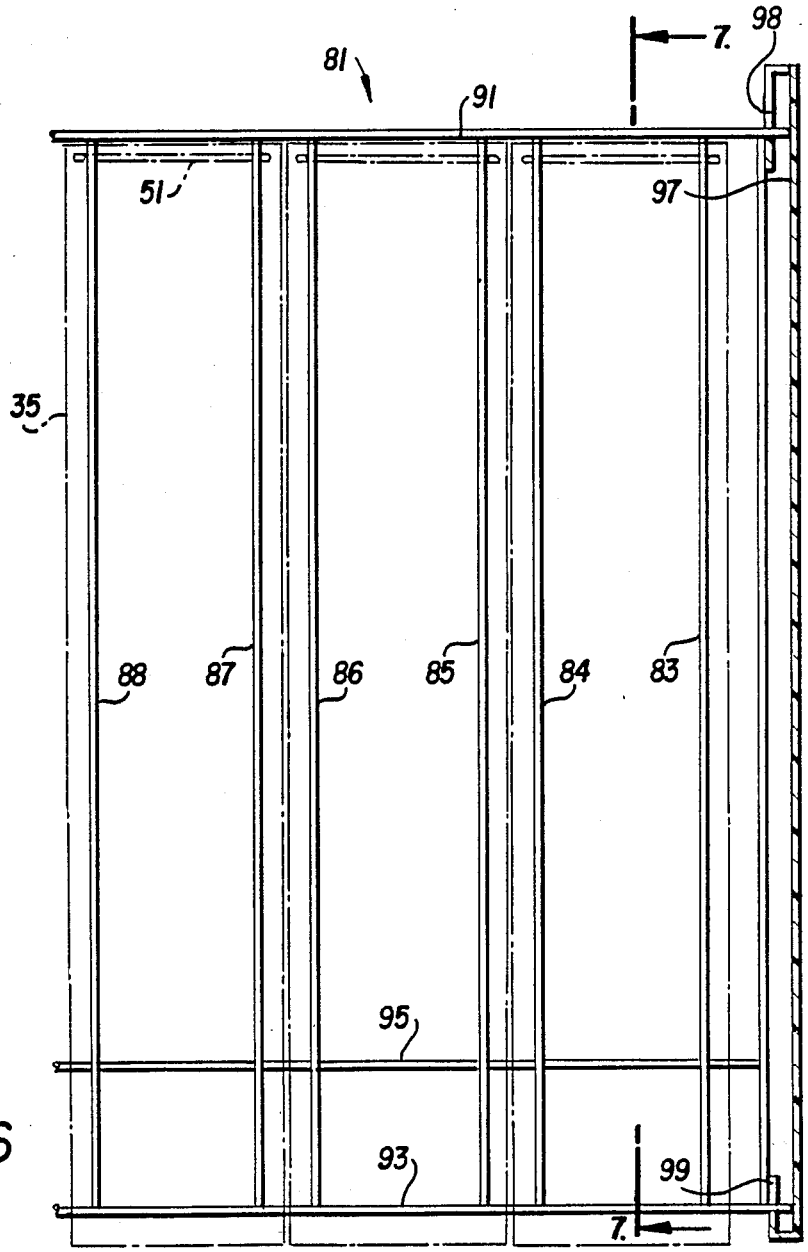
FIG. 6

DISPLAY AND GRAVITY DISPENSING APPARATUS

This invention relates broadly to display and dispensing apparatus and more particularly to a rack and tray system which may be used for display and gravity dispensing, and which may also be easily moved into a position for restocking a particular display.

Gravity flow dispensing type racks are well known in the art. One such device is shown in U.S. Pat. No. 4,311,243 which discloses a gravity flow rack which is constructed of a bent wire frame so as to provide shelving. This is a fixed frame display and all restocking must be done with the rack in its permanent fixed position.

U.S. Pat. No. 4,397,607 discloses an article handling apparatus which, although not a gravity dispensing device, is designed so as to be able to be moved into a restocking position. The trays used are arranged side-by-side and are slidably mounted in a horizontal position so that the trays may be moved outwardly for stocking purposes.

U.S. Pat. No. 4,461,388 discloses a device for adapting standard shelves to become shelves which provide a gravity feed for dispensing articles. Again, all restocking must be done with the shelves in the position as shown.

U.S. Pat. No. 3,894,634 discloses a display and delivery stand which holds shelves in a slightly inclined position and in which roller runways may be used.

The display racks that are known to the inventors as well as racks that use gravity feed flow for dispensing are all of a substantially fixed structure, and those which are movable include rollers or complicated arrangements which are relatively expensive to produce and which include parts which tend to break or wear out.

Accordingly, it is an object of this invention to provide a display and gravity dispensing apparatus which is easily moved to a restocking position.

A further object of this invention is to provide a gravity and dispensing rack which is constructed of basic rod type material and which includes no moving parts.

A still further object of the invention is to provide a basic wire rack inclined at an angle which supports a plurality of trays for containing the merchandise, and wherein the trays themselves may be withdrawn partially so as to restock them without actually taking them completely out of the merchandising case.

A still further object is to provide a changing angle as the tray is withdrawn to facilitate loading new stock behind the existing stock.

These and other objects of the invention will become obvious from the following description when taken with the drawings.

BRIEF DESCRIPTION OF THE DRAWINGS

FIG. 4 is a sectional view taken along the lines 4—4 of FIG. 3;

FIG. 5 is a partial sectional view taken along the lines 5—5 of FIG. 3;

FIG. 6 is a partial plan view of a wire rack used with the present invention.

SUMMARY OF THE INVENTION

The present invention discloses a display and gravity dispensing apparatus comprising a housing means having an opening in the front thereof and at least one elongated support means mounted in the housing having a downward inclination toward the opening of the housing. A tray for containing the goods to be dispensed is slidably secured on the elongated support by a guide retainer and is maintained in a first angularly inclined position for dispensing the goods. The tray may be moved and supported in an extended position inclined at a greater angle for restocking the tray with the goods.

DETAILED DESCRIPTION OF THE DRAWINGS

Figure 1:
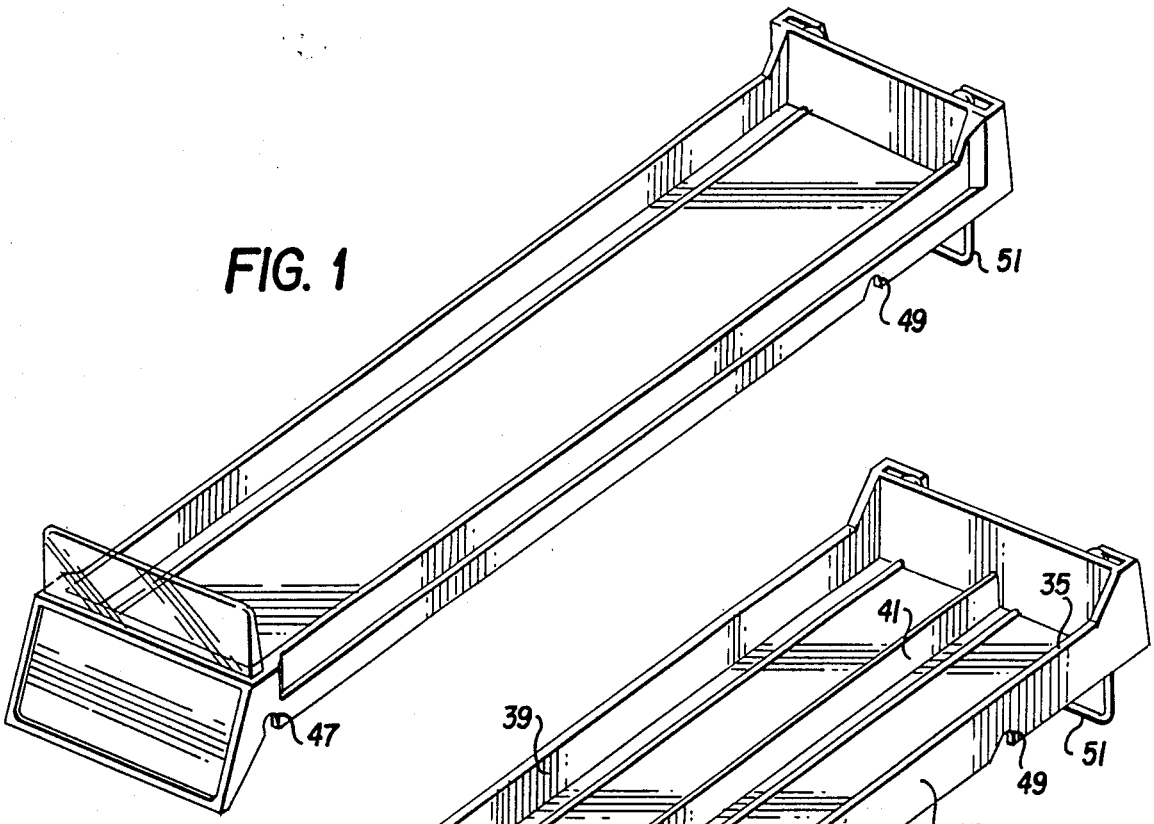
FIG. 1 is a perspective view of one tray which may be used with the present invention.

Turning now to FIG. 1, there is disclosed tray 11 having bottom 13, side walls 15 and 17, rear wall 21 and flange 19 extending downwardly from the forward part of the tray. U-shaped retainer-guide 23 is removably secured to the rear of tray 11 and terminates in hooks 25 and 27. The purpose of retainer-guide 23 will become obvious as the description proceeds. Notches 29 and 31 are provided in the walls of the tray for maintaining the tray in two separate positions as will be described in detail hereinafter. Additionally, in order to retain the goods at the front of the tray, abutment 32 is secured to the front of the tray. The abutment in the particular illustration is made of clear plastic. It is intended that the basic tray be of molded plastic so as to be a unitary structure. Additionally, tracks 33 are secured to bottom 13 of the tray in order to reduce the friction of the items which are designed to be fed to the front of the tray by gravity.

Figure 2:
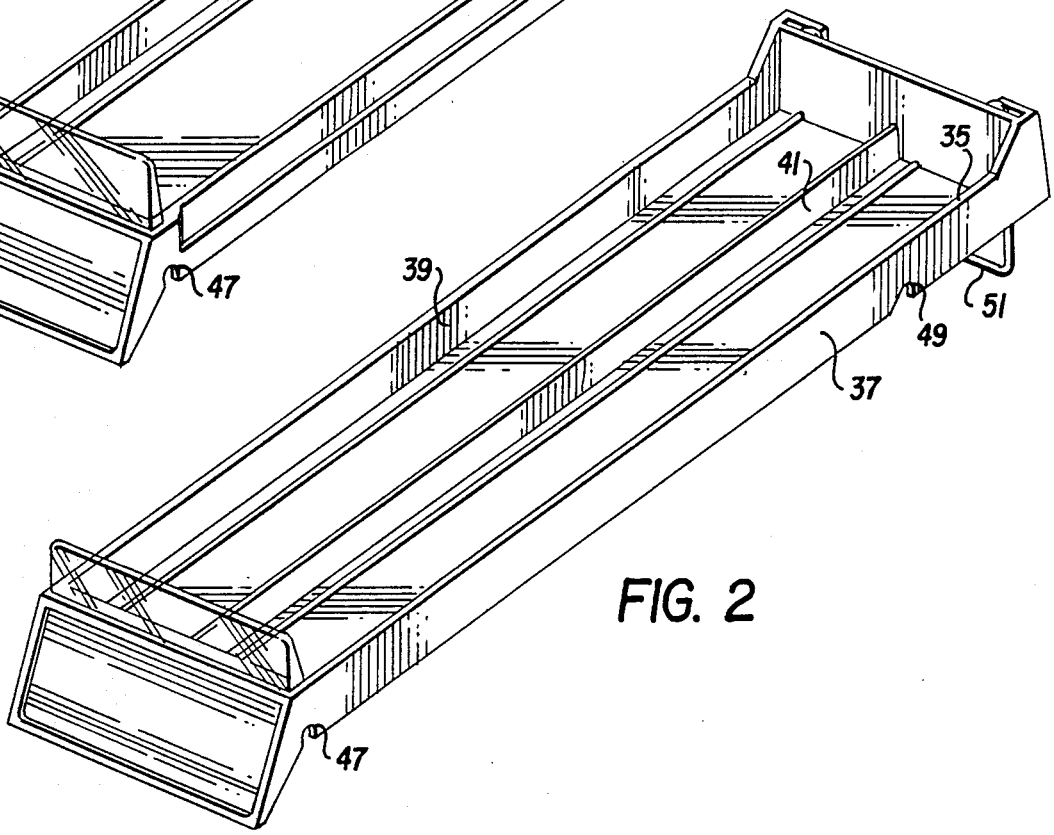
FIG. 2 is a perspective of a modification of the tray of FIG. 1.

FIG. 2 discloses a modification of the tray of FIG. 1 with tray 35 having walls 37 and 39 and central partition 41 so as to provide two storage areas for the goods to be dispensed. Again, there is a downward extending flange 43 at the forward part of the tray and a terminal rearward wall 45 at the rear of the tray. As in FIG. 1, notches 47 and 49 are provided in the lower part of each of the walls. Retainer-guide 51, similar to the retainer-guide 23 of FIG. 1 terminates in hooks 53 and 55.

Figure 3:
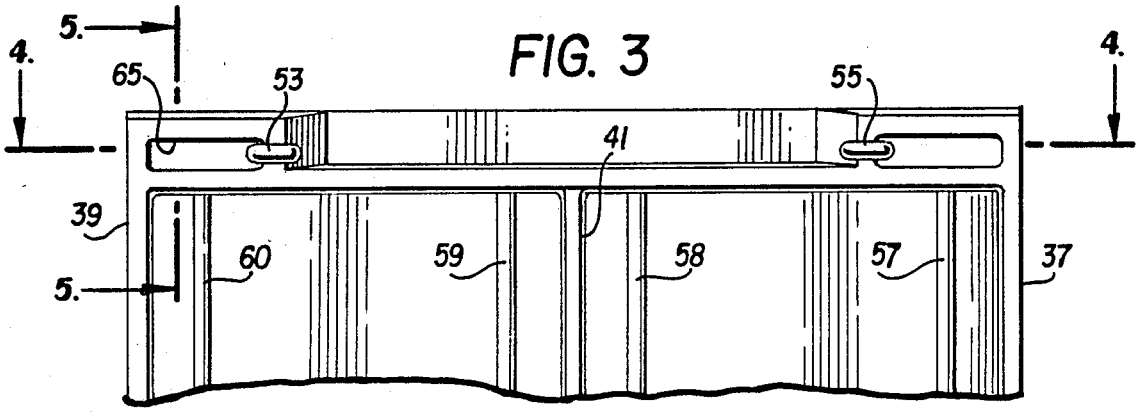
FIG. 3 is a partial plan view of the rearward portion of the tray of FIG. 2.

FIG. 3 illustrates the rear section of the tray of FIG. 2. The rear section of the tray is constructed so that retainer-guide 51 may be removably inserted and held in the position shown.

The rearward part of the tray terminates in channels 63 and 65 at either side thereof. It is to be understood that these channels extend through to the bottom of the tray. In placing retainer-guide 51 so as to be secured to the tray, hooks 53 and 55 pass upwardly through the channels and are sprung outwardly in the process until they pass above end walls 67 and 69 of the channels. At that time, they spring closed over the channel and may be pulled downwardly so as to grip the walls 67 and 69.

The sectional view of FIG. 4 illustrates the structure more clearly wherein it can be seen that, when guide 51 is in its final position, hooks 53 and 55 rest about end wall 67 and 69.

It can be seen that the channels, as illustrated by channel 65, taper at the lower end 66 thereof. This is designed so as to act as a guide for the ends of the retainer 51 as it is being mounted on the tray. It will also assist in spreading the hook ends of the retainer a they are passing upwardly.

Figure 7:
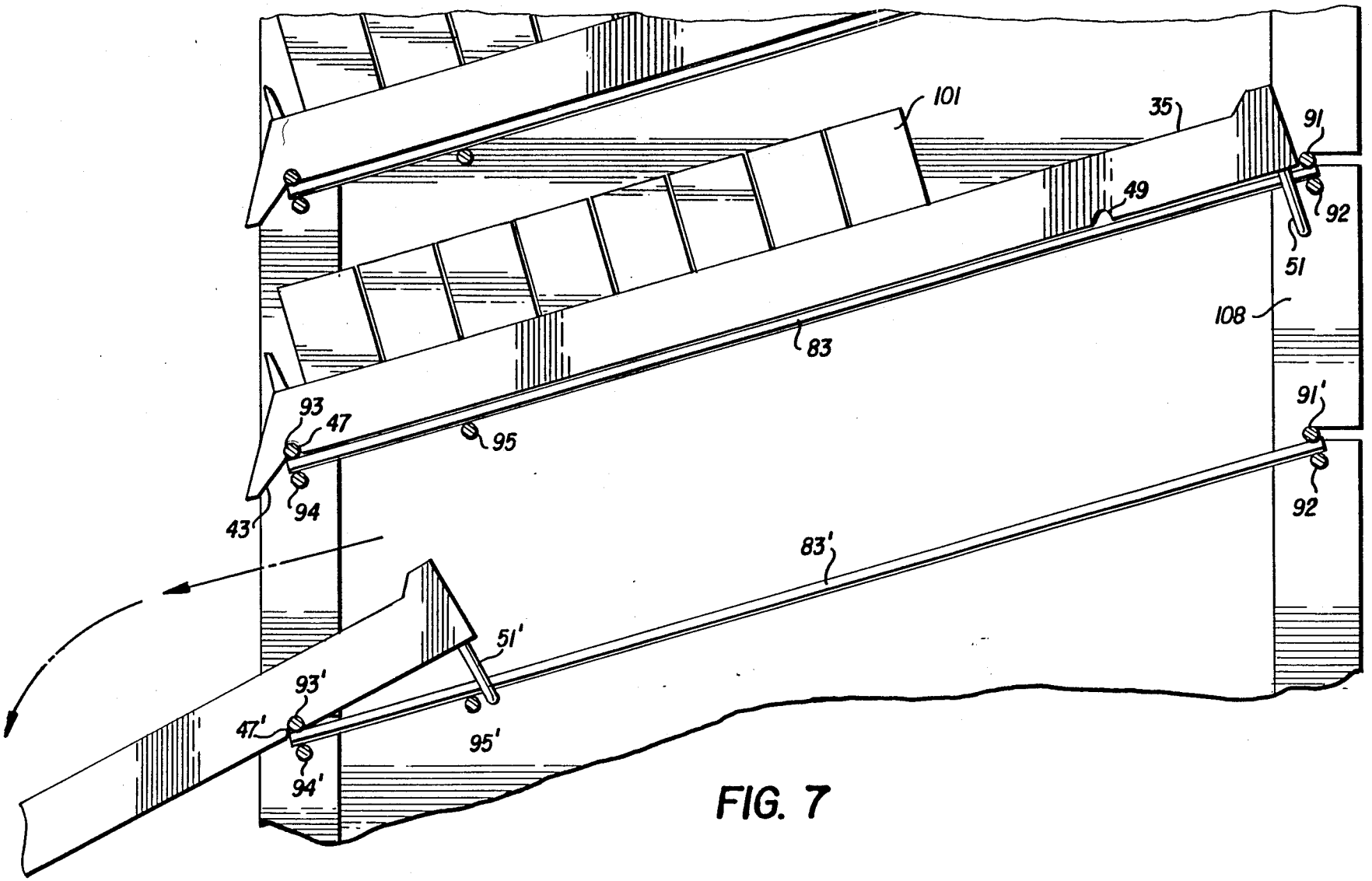
FIG. 7 is an illustration of a plurality of racks and trays of the present invention showing the trays in their dispensing and restocking position.

FIG. 6 is a partial plan view of a rack which is used for supporting the trays in their positions. Three pairs of substantially parallel rods 83–84, 85–86 and 87–88 are shown. It is to be understood that any member of such supports may be used. Transverse rods 91 and 93 are secured to the pairs of rods by means such as welding and the like. As can be seen in FIG. 7, similar rods 92 and 94 are secured to the underside of the parallel rods so as to increase the structural strength of the rods. An additional transverse rod 95 is welded below the parallel rods at a predetermined spaced distance to the rear of forward transverse rod 93 for reasons which will be discussed as the description proceeds. It is to be understood that this frame structure is to be mounted within a housing, which may be a housing which is portable and may be moved to various locations within a store, or which may be a housing permanently fixed within a store. Such a housing is partially illustrated showing a side wall 97 having slotted flanges 98 and 99 into which the extending transverse rods may be inserted. The racks may be mounted within the housing in any well-known manner in accordance with the particular requirements dictated by the location and use of the structure.

As illustrated, each of the pairs of parallel rods has the associated retainer-guide passing underneath the rods with the upstanding arms extending upwardly and into the trays which, in FIG. 6, are shown as trays 35 in dashed lines. Thus, the trays rest on their associated parallel rods and are maintained thereon by a retainer-guide 51.

Turning now to FIG. 7, the operation of the trays and racks of the present invention is shown. In this illustration, there are shown three sets of racks mounted horizontally with respect to each other. The racks are secured in any manner to the side walls and extend from the rear part of the container forward of the rear wall 103. The upper two racks are shown in a dispensing position at the desired inclination, such as 12°, with articles, such as cartons of milk 101, or the like, resting in their respective trays. As can be seen, forward notch 47 in the lower wall of tray 35 is placed so as to mate with rod 93. Rods 93, 94, 91, 92 and 95 are welded to parallel rods 83 as discussed hereinabove. As previously stated, use of the upper and lower end rods provide not only a support for parallel rods 83 but also strengthens the overall structure. Rod 95 adds to the strengthening of the structure and also provides a further function as is shown in the lower rack of FIG. 7.

In FIG. 7 the lower rack has been raised by grasping the flange 43 and lifting it so as to free notch 47 from rod 93. The rack is then slid outwardly along rods 83' until notch 49' is in a position to mate with rod 93'. U-shaped guide retainer 51' has legs of a sufficient length so as to allow the rear end of the tray to move upwardly in the direction of the arrows so as to rotate about rod 93' thus allowing the tray to extend outwardly at a greater inclination than the inclination which is used for the standard gravity dispensing. Additionally, rod 95' is spaced at a distance relative to the location of notch 49' in the tray such that, in the position shown in FIG. 7, retainer-guide 51' abuts against rod 95' so as to prevent further sliding movement along parallel rods 83'. Thus, the tray is prevented from tipping beyond the desired restocking position, for example, an angle of 30°. The dispensing and restocking angles may be adjusted depending upon the type of stock which is to be dispensed.

Although the rack could be constructed of a number of materials or could be constructed as a planar support, the preferable construction includes the parallel rods which will flex to a certain degree. In order to provide such flexibility, the rack may be made with ¼ inch cold rolled steel rods. The reason for the flexibility is that if the tray is moved to the restocked position with items still in the tray, the additional force caused by the increased weight of the stock will cause a shock effect on the tray. By providing flexible rods, the rods will absorb some of the shock which results from this force and, thus, will aid in preventing any damage to the tray itself or to any of the articles or stock which is in the tray.

As will now be obvious, the present invention provides a system of displaying, gravity feeding and easily restocking a container or rotating the stock with a plurality of items which are to be gravity fed without increasing shelf capacity and without requiring complete removal of the tray. The system is relative inexpensive to manufacture and contains substantially no moving parts which are subject to wear and/or damage.

It is to be understood that the above description and drawings are illustrative only and the invention is to be limited only by the scope of the following claims.

We claim:

1. Display and gravity dispensing apparatus comprising housing means having an opening in front thereof;

at least one elongated support means;

means for mounting said support means in said housing, said support means having a downward inclination angle toward said opening;

at least one tray slidably mounted on said support means, said tray having a solid, substantially planar bottom;

first means for securing said tray on said support means substantially within said housing in a gravity dispensing mode;

second means for securing said tray on said support means so that said tray extends beyond said opening at an inclination angle greater than the inclination angle of said support means so as to place said tray in a restocking mode.

2. The apparatus of claim 1 wherein said first means comprises a transverse rod secured to the upper front portion of said support means; and a notch in the lower forward portion of said tray for mating with said transverse rod.

3. The apparatus of claim 2 wherein said second means comprises a notch in the lower rear portion of said tray; and a U-shaped guide-retainer having its ends secured to the rear of said tray and about and below said elongated support means.

4. The apparatus of claim 3 further comprising a second transverse rod secured to the underside of said support means a predetermined distance from the front of said support means so that the bight of said U-shaped member contacts said second transverse rod when said tray is in said restocking mode so as to limit the forward movement of said tray.

5. The apparatus of claim 1 wherein said support means comprises a pair of spaced parallel rods.

6. The apparatus of claim 5 wherein said rods are formed of a cold-rolled steel.

7. The apparatus of claim 1 further comprising a plurality of tracks extending upwardly from the upper face of the bottom of said tray, said tracks extending substantially the length of said tray.

8. The apparatus of claim 1 further comprising at least one dividing wall extending upwardly from the upper face of said tray bottom, said dividing walls extending substantially the length of said tray.

9. The apparatus of claim 1 further comprising a peripheral wall extending above said tray.

10. The apparatus of claim 1 further comprising a transparent abutment secured to and extending above the front of said tray.

11. The apparatus of claim 1 wherein said means for mounting said support means comprises a plurality of longitudinally extending rods;

a plurality of transverse rods secured to and extending beyond said longitudinally extending rods; and slotted flanges on said housing means for mating with and supporting the ends of said transverse rods.

* * * * *